US005335497A

United States Patent [19]

Macomber

[11] Patent Number: 5,335,497

[45] Date of Patent: Aug. 9, 1994

[54] ROTARY STIRLING CYCLE ENGINE

[76] Inventor: Bennie D. Macomber, 2214 W. Las Flores, Ridgecrest, Calif. 93555

[21] Appl. No.: 971,811

[22] Filed: Feb. 10, 1993

[51] Int. Cl.[5] ..... F02G 1/04

[52] U.S. Cl. ..... 60/519; 60/641.8; 60/676

[58] Field of Search ..... 60/517, 519, 525, 641.8, 60/676

[56] References Cited

U.S. PATENT DOCUMENTS

| | | | |
|---|---|---|---|
| 4,009,573 | 3/1977 | Satz | 60/519 |
| 4,206,604 | 6/1298 | 0Reich | 60/519 X |
| 4,357,800 | 11/1982 | Hecker | 60/519 |
| 4,753,073 | 6/1988 | Chandler | 60/519 |

*Primary Examiner*—Stephen F. Husar

*Attorney, Agent, or Firm*—Albert O. Cota

[57] ABSTRACT

A rotary Stirling cycle engine which has a pair of hollow chambers (20) each having an elliptical rotor (30) positioned inside and rotatably sealed to the chambers inner walls. A crankshaft (40) connects the rotors in tandem to transmit rotational energy when the rotors revolve around the chambers. A cooling and a heating heat exchanger (44) and (48) are each connected through ports (26) and (28) in the chambers sidewalls one to the other. Working fluid (60) is present at a constant volume within the chambers and heat exchangers, revolving the rotors as the volume in each chamber changes due to the cyclic expansion and contraction of the working fluid as it sweeps around the chambers through the ports while being alternately heated and cooled by the heat exchangers.

22 Claims, 4 Drawing Sheets

ROTARY STIRLING CYCLE ENGINE

TECHNICAL FIELD

The present invention relates to Stirling cycle engines in general and more specifically to improvements using rotary chambers with ports and external heat exchangers to alternately heat and cool the working fluid effectively producing rotational mechanical work.

BACKGROUND ART

Previously many alternative types of systems have been introduced in endeavoring to improve and provide an efficient and practical Stirling cycle engine. Since its conception, in the early nineteenth century, a displacer and output power piston was operated in the same cylinder. More recently, some have attempted to use rotary mechanisming which have by their very nature reduced extraneous volume not swept by the pistons thereby enhancing compression resulting in efficiency beyond those of the early days. However, the present internal combustion engine has still far surpassed the efficiencies of the not only original concept developed by Stirling but even the latest improvements by others.

The use of rotors instead of pistons is just now becoming a practical reality due to the exhaustive development of rotary engines for automotive applications and fluid pumps. The need still exists however for the utilization of a system that will yield efficiencies duplicating or exceeding the latest piston engine technology.

A search of the prior art did not disclose any patents that read directly on the clams of the instant invention however, the following U.S. patents were considered related:

| U.S. PAT. NO. | INVENTOR | ISSUED |
|---|---|---|
| 4,753,073 | Chandler | 28 June 1988 |
| 4,179,890 | Hanson | 25 December 1979 |
| 4,044,559 | Kelly | 30 August 1977 |
| 3,984,981 | Redshaw | 12 October 1976 |
| 3,958,422 | Kelly | 25 May 1976 |
| 3,537,256 | Kelly | 3 November 1970 |
| 3,370,418 | Kelly | 27 February 1968 |

Chandler in U.S. Pat. No. 4,753,073, improved the Stirling cycle using three rotors each separately rotatable within a toroiadal housing cavity. Each rotor contains a pair of rotor blocks forming six separate chambers. Heat exchangers are employed and relative angular rotor movement within the chambers is achieved by meshing elliptical gears connected to a common output shaft.

Hanson teaches in U.S. Pat. No. 4,179,890 an epitrochoidal Stirling type engine using a three-lobed rotary piston in a four-lobed housing. A cam is coaxially mounted between rollers in sufficient preciseness to eliminate peripheral seals. Connectors for fluid flow between pairs of lobes permit the cycle to receive heat on one end and discharge it from the other.

U.S. Pat. No. 4,044,559 issued to Kelly discloses a closed series cycle or double-acting reciprocating Stirling engine cycle. Tandem rotary units employ a series gas flow loop using a large number of heat transfer tubes with separation between the hot and cold sources. Hydrogen gas is used as fuel obtained from an electrolysis unit driven by a wind generator.

Redshaw employs a rotary Stirling cycle system in U.S. Pat. No. 3,984,981 utilizing rotors also internal heat exchangers, and displacers as heat regenerators. Chambers are formed with two wedge-shaped spherical sectors connected by a disk-like coupling producing four variable displacement chambers. Sectors contain passageways through hollow shafts covered with fins to provide heat transfer porous heat absorbing material becomes the heat regenerator transferring heat from one chamber to the other.

U.S. Pat. No. 3,958,422 also issued to Kelly uses multiple rotary units having an eccentric rotor with vanes independent from adjacent units. Multiple heat transfer loops with heating and cooling sources provide the regeneration heat transfer. Hydrogen is employed as the working gas with any suitable fuel used as the heat source.

Kelly in an earlier patent (U.S. Pat. No. 3,537,256) uses two simple eccentric rotors with vanes and interconnecting flow paths. A modular split housing allows valves to be connected to both rotors. The heat is optically transmitted to a hot displacer. Photo heat powered by liquid fuel or electrical lamps provides the heat source for the invention.

Finally, Kelly in U.S. Pat. No. 3,370,418 issued a few year earlier disclosed a pressurized Stirling cycle engine employing both axial and radial gas flow. Two in-line cylinders are used, each having a truncated rotor and multiple rings on the rotor having impeller blades. A shaft supports the rotor and endplates with bearings support the shaft. A number of ports freely communicate with the cylinders allowing heat transfer and a circular regenerator provides internal counter-balancing.

DISCLOSURE OF THE INVENTION

Many attempts have been made over the years to improve the basic Stirling cycle heat engine endeavoring to make it a practical efficient source of mechanical energy. Much work has been accomplished in the field of rotary engines such as the wankel type which rendered the rotary engine principle and workable reality perfecting the rotor tip seal and rotor side sealing to the chamber. As the state of the art is advancing in this discipline, it is a primary object of the invention to combine this latest technology using a pair of rotors within mating chambers connected in tandem with external heat exchangers to add and remove heat in operation of the basic engine cycle replacing the reciprocating cylinders with a rotary mechanism.

An important object of the invention improves the ultimate efficiency of the apparatus by the complete separation of the high and low temperature working spaces. This is accomplished using ports in each chamber separating the working fluid intake from the discharge. A pair of chambers are utilized with elliptical shaped rotors linked together on a common shaft inside each chamber with the ports having an orientation synchronizing the rotors. This arrangement permits a constant volume heat rejection and addition during a half revolution of the shaft where no work is performed except for that necessary to overcome friction. During the second half revolution work is accomplished by the expansion and contraction of the working fluid.

Another object of the invention that is new and novel is the unidirectional flow of working fluid through the heat exchangers. This flow path is unlike prior art where the fluid flows from one end to the other along a gas filled cylinder where the gas is transferred alternately to the hot and cold spaces at the ends of the cylinder with the resultant cyclic temperature changes which cause pressure modulation used to drive an output power piston or the like. The fluid flow path of the present invention now distinctly separates the hot and cold chambers with their accompanying rotors such that a unidirectional flow of the working fluid, or gas, is always present ultimately improving the efficiency of the basic Stirling cycle. Further, this arrangement minimizes the loss of heat by conduction in the mass which completely bypasses the process of producing work.

Still another object of the invention is directed to the basic utilization of only one heat exchanger between the high and low temperature working spaces in the inventions simplest form. Further, the residual heat remaining after extracting work from the fluid is employed to preheat the working fluid, thus utilizing all of the heat to its best advantage, rather than purging this heat to atmosphere, after the original task has been accomplished. Inasmuch as the heat must be produced in the first place to generate work, the better employment of this energy yields higher efficiency which, ultimately, permits a practical application of the fundamental invention of Stirling.

yet another object of the invention is the use of only rotary motion to produce power. Vibration in this type of apparatus is greately reduced over reciprocating types of engines using pistons within cylinders moving in a linear direction. Engine vibration may be a source of problems to driven equipment therefore, the reduction in potential vibration is an important part of the inventions utility and wide spread application potential.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
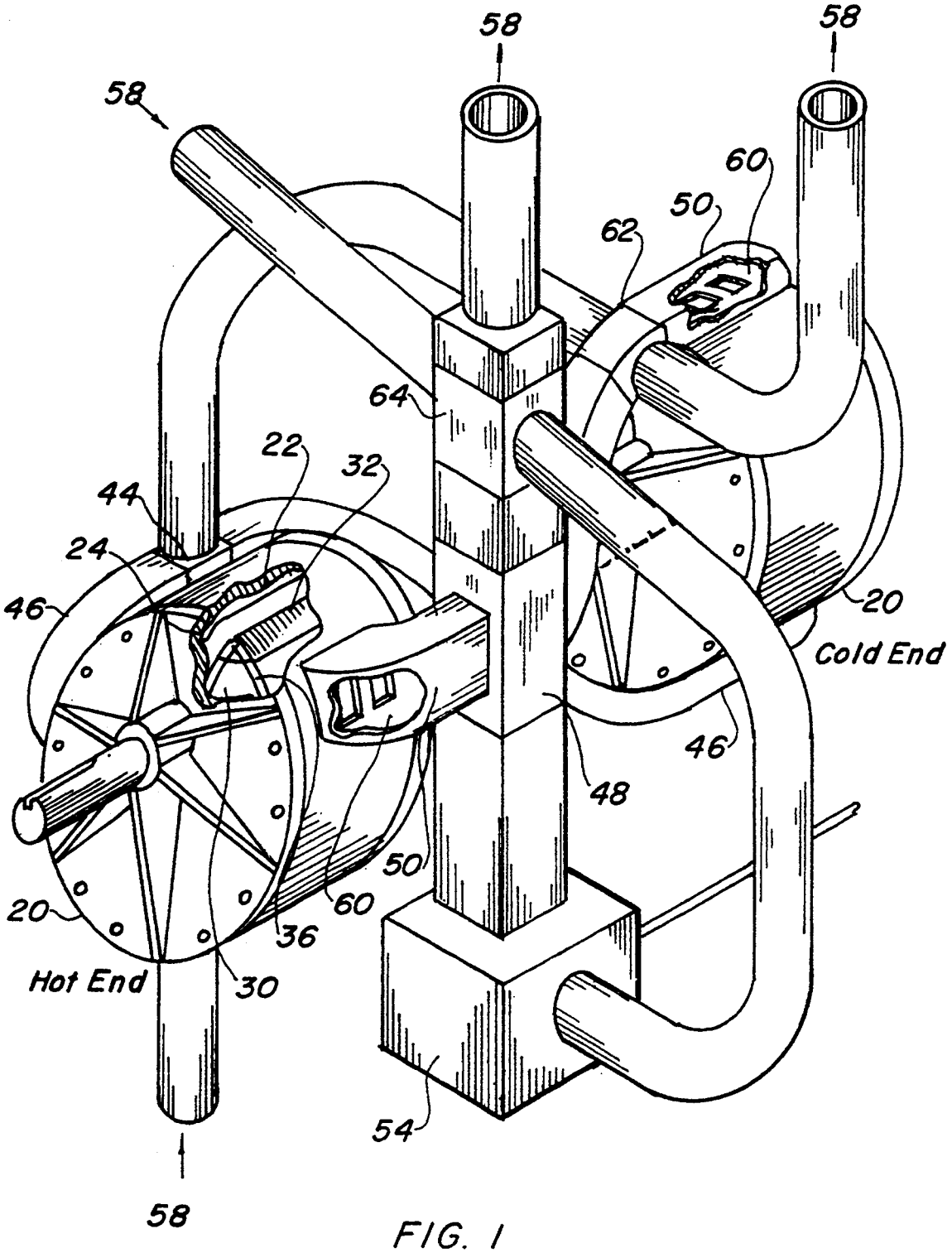
FIG. 1 is a partial isometric view of the preferred embodiment however, in order to visually depict the heat exchangers in their relative position, they are not necessarily proportionate in size. The view also contains cut-away portions to illustrate the critical operating elements.

The preferred embodiment, as shown in FIGS. 1 through 10 is comprised of at least a pair of hollow chambers 20 placed in end to end relationship as illustrated in FIG. 1. These chambers 20 are basically the same configuration except for slight variations in connecting locations etc., each chamber further having internal sidewalls 22 and endwalls 24. The basic shape of the chambers 20 is elliptical and it has been determined that the most optimum shape of the ellipse employs rectangular coordinates illustrated in FIG. 3 calculated by the following mathematical equation:

$$X=t(Sin\ 2a+5\ \text{Sin a})$$

$$\text{and } Y=t(\text{Cos } 2a+5\ Cos\ a)$$

where: "t" is the crankshaft throw (illustrated in FIG. 6) and "a" is one half the crankshaft rotational angle in degrees. (0–360° to completely describe the chamber sidewall)

The outside configuration or case may be any shape and construction having sufficient structural integrally to accomplish the task. FIG. 1 best illustrates the preferred embodiment in this area.

The chambers 20 further contain a pair of ports, for clarity sake designated the first port 26 and second port 28, with the positioning of the ports relative to each other and the mating chamber of prime importance. FIGS. 2 and 7–10 illustrate this physical location and it will later become apparent as to their functional purpose.

Figure 5:
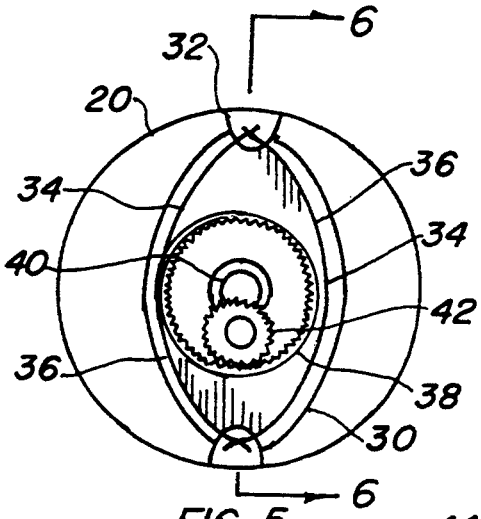
FIG. 5 is a cross-sectional view of one of the rotors within a chamber having the endwalls removed for clarity.

Each chamber 20 contains an elliptical shaped rotor 30, only slightly narrower than the chamber, and of such a radial configuration as to have rotatable contact against the inner sidewalls 22. The rotors 30 are free to revolve within the chambers and contain a rotatable tip seal 32 positioned at the narrowest portion of the elliptical shape. This tip seal 32 is well known in the art and seals the rotor 30 against the sidewalls 33 of the chamber and in connection with ports 26 and 28 provides porting of the working fluid 60 as it rotates. Further, the rotor 30 contains a curved groove 34 in each side as shown in FIG. 5 in which a spring loaded curved side seal 36 is positioned. The side seal 36 interfaces contiguously with the tip seal 32 completely sealing the rotor 30 within the chamber 20.

Figure 6:
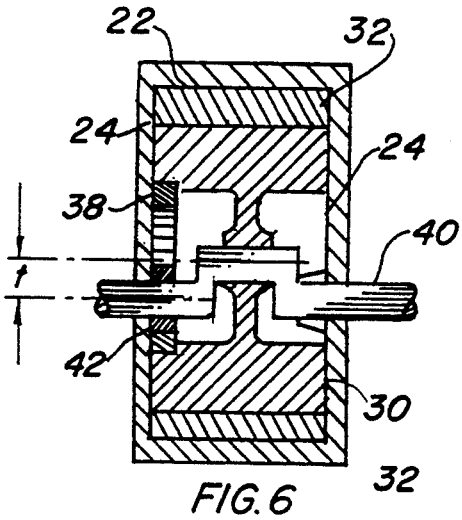
FIG. 6 is a cross-sectional view taken along lines 6—6 of FIG. 5 illustrating the crankshaft.

The elliptical shape of the rotor 30 is formed of two intersecting arcs having a radius "r" whose centers are separated by the same distance "r" defined by the following mathematical equation:

$$r=L/Cos\ 30\ degrees$$

where "L" is equal to 5 times the crank throw (shown in FIG. 6)

Figure 4:
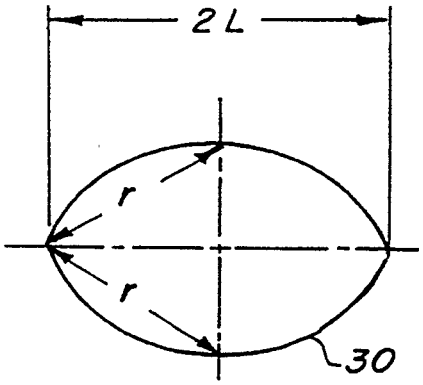
FIG. 4 is a diagram of the geometry of the rotor shape.

This shape and physical layout is depicted in FIG. 4 and also shown pictorially mating with the chamber 20 in the schematic diagrams.

Each rotor 30 contains drive movable orientation means in the form of a centrally located internal toothed ring gear 38 as illustrated in FIGS. 5 and 6. The gear 38 is pressed on or otherwise attached to the rotor and is large enough to almost fill the width of the rotor and is relatively close to the side seals 36.

A crankshaft 40 connects the rotors 30 together in tandem as shown in FIG. 1, at an opposed offset orientation. Stationary orientation means in the form of an external tooth pinion gear 42 concentric to the crankshaft 40 is permanently attached to the chamber endwall 24 is illustrated in FIG. 6. The external teeth of the pinion gear 42 mesh with the internal teeth of the ring gear 38 synchronizing the rotors 30 keeping them in opposed relationship and positioned intimately with the chamber sidewalls 22 as the rotor revolves within the chamber 20.

In the preferred embodiment, the ring gear 38 has twice as many teeth as the pinion gear 42 causing the rotor 30 to rotate at one half the rate of the crankshaft to maintain a system balance and provide sequence to each rotor revolution relative to the ports 26 and 28.

A cooling heat exchanger 44 is connected through conduits 46 between the first ports 26 of each chamber 20. The cooling heat exchanger 44 is an air to gas device arranged in a thermal counter flow orientation allowing mass flow of media in opposed directions.

A heating heat exchanger 48 is likewise connected through passageways 50 between the second ports 28 of each chamber 20. This heat exchanger adds heat to the cycle as the basic heat source for engine operation. The heat may be produced by almost any fuel that elevates the temperature usually through a conducting fluid such as air or liquid.

Figure 2:
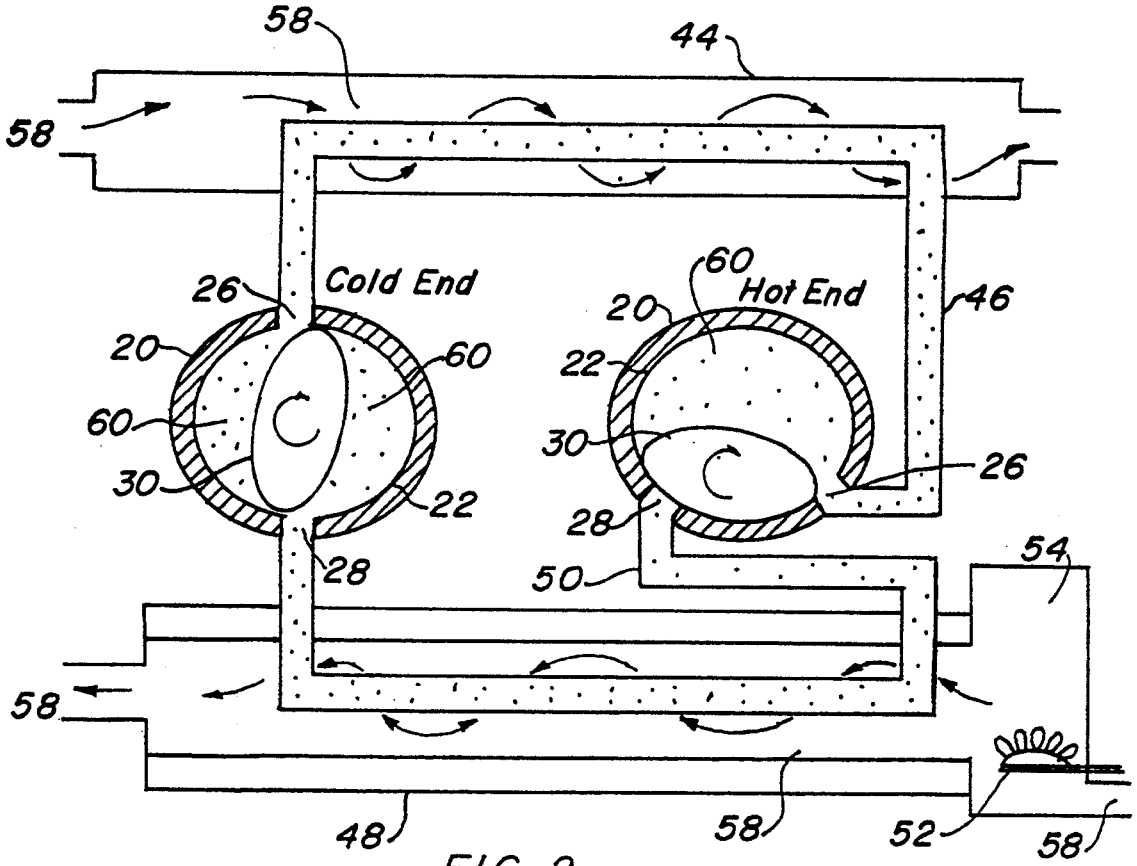
FIG. 2 is a schematic diagram of the components within the cycle and the orientation of the rotors relative to the ports and interconnecting heat exchangers.
Figure 3:
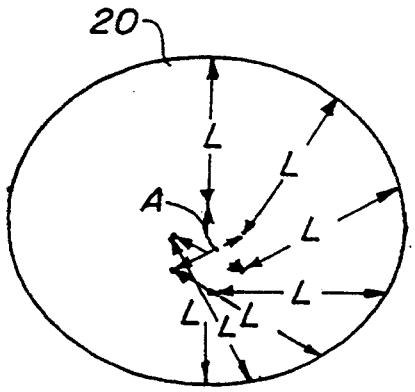
FIG. 3 is a diagram of the chamber inner geometry depicting the rectangular coordinates forming the elliptical shape.

The heat source may be any type such as employing a combustion burner 52 as illustrated in FIG. 2 in the form of fossil fuel i.e., gasoline, diesel butane/propane, natural gas and the like or any other flammable fuel used to produce heat during a combustion process. FIG. 2 illustrates a burner 52 in conjunction with a combustion chamber 54 where liquid fuel is mixed with ambient air and burned producing heat which is then in communication with the passageway 50 between ports 28.

Figure 11:
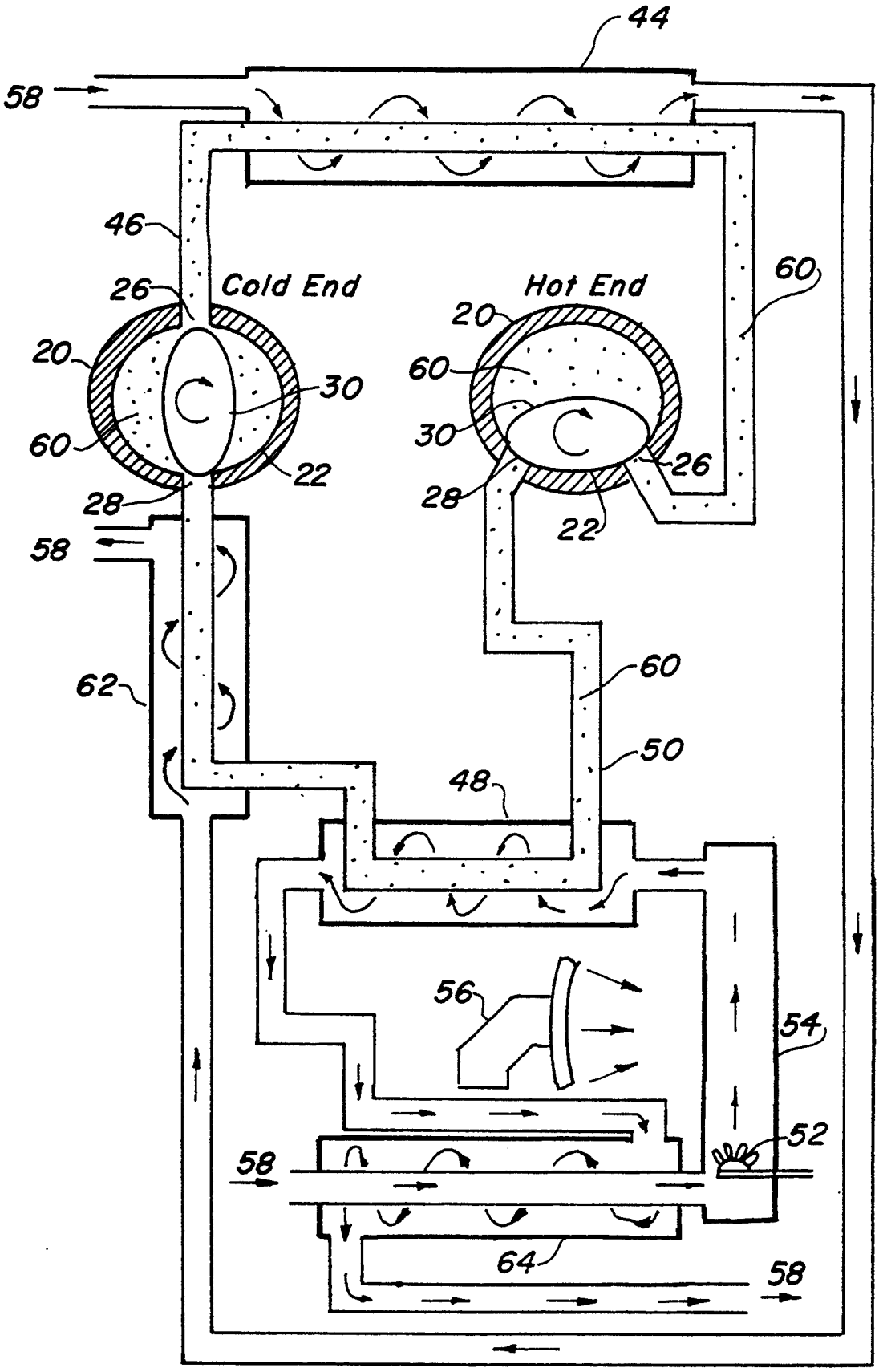
FIG. 11 is a diagram of the components within the cycle including a solar collector for the heat source and all optional heat exchangers to produce an extremely efficient system.

A variety of heating means may be also used other than the combustion type described above such as a solar generator 56 depicted schematically in FIG. 11. The solar generator 56 may be any type known in the art and may use a secondary heat transfer fluid such as a liquid shown in the drawings or any other means together the sun's rays in sufficient concentration to produce heat. It will be noted that the invention is not limited to the heat sources identified in the preferred embodiment as any source of heat may be employed with equal ease and conformity. Any of the above described heating means may also use a conducting fluid 58 such as air or liquid with the heat source elevating the temperature of the conducting fluid 58 and transferring the heat to the engine through mass flow within the heat exchanger 48.

A working fluid 60 is sealably contained at a constant volume within the chambers 20 and heat exchangers 44 and 48 provide the operational potential to rotate the rotors 30. When the volume in one chamber in communication with the first ports 26 is at a maximum condition on one side of the chamber 20 and the volume of the mating chamber 20 in communication with the second ports 28 is minimum the rotors 30 are forced to rotate by expansion and contraction of the fluid 60. The heat extracted by the cooling heat exchanger 44 causes the working fluid 60 to contract or decrease in volume creating a volumetric divergence sweeping the fluid around within and between the chambers 20 causing the cyclic action of the rotors thereby producing work.

This working fluid may be any substance suitable for the application including air, or a gas such as helium, hydrogen, chlorinated fluorocartions and the like as these and their gases are good conductors of heat allowing rapid heating and cooling of the working fluid 60. Function of the basic cycle is illustrated schematically in FIGS. 7–10 and for clarity sake may be described as follows:

As previously stated the chamber 20 is nearly circular inside the hollow portion and the rotor 30 is placed inside such that its rotor tips maintain constant contact against the sidewalls 22 providing a seal. The crankshaft 40 revolves such that the center of the crank creates a circle as the shaft rotates. The external toothed gear 42 situated concentric to the shaft is fixed mechanically so as not to rotate and is meshed with the internal toothed gear, having twice the number of teeth, and attached to the rotor permitting the rotor to rotate in the chamber 20 at one-half the rate of the shaft 40. The depiction of the gears has been mitted from the schematic in FIGS. 7–10 for reasons of clarity although they are an important part of the invention as they provide the proper positioning of the rotor during rotation.

Figure 7:
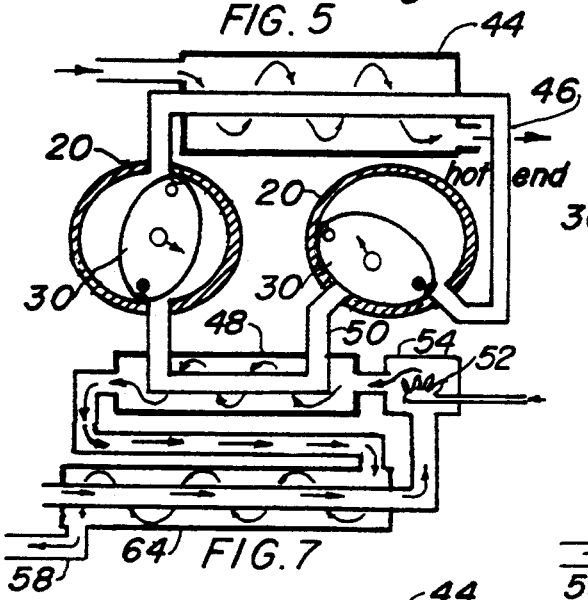
FIG. 7 is a diagram of the rotor position at the start of the cycle where there is minimum volume below the rotor on the cold end at the beginning of the constant volume heat transfer phase.
Figure 8:
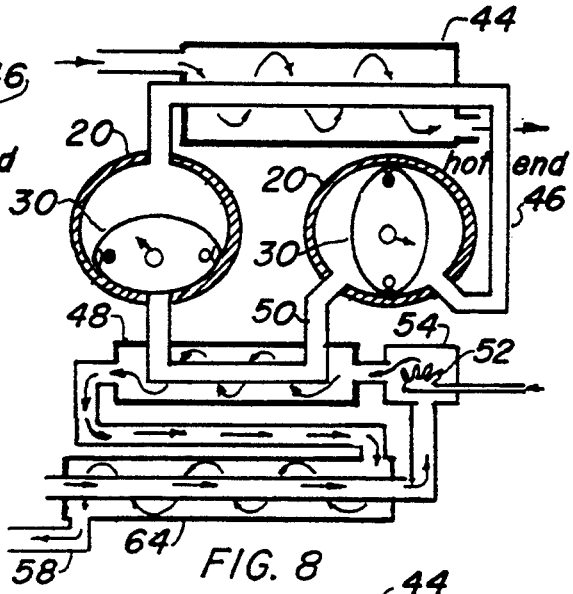
FIG. 8 is a diagram of the rotor position at the end of the heat transfer phase and the beginning of heat expansion and cold contraction of the working fluid phase.

In position 1 of FIG. 7, the rotor 30 of the hot end is shown at the bottom of the chamber 20 permitting a minimum volume below the rotor and a maximum volume above the rotor. It may be seen by referring to position 2 in FIG. 8, as the shaft rotates clockwise, the volume below the rotor is increasing and the volume above the rotor is decreasing. In reaching position 2, the shaft has rotated almost 180 degrees and the rotor has rotated almost 90 degrees. In position 3 shown in FIG. 9, the volume below the rotor has increased to about the maximum and the volume above has decreased equally. At this halfway point, it is noted that the shaft has rotated almost 360 degrees and the rotor has rotated almost 180 degrees. As rotation continues, the volumes continue to change as shown in position 4 in FIG. 10 where the rotor is now the reverse of what it was originally. One revolution of the shaft allowed one side of the rotor to go from minimum volume to maximum volume and the other side to go from maximum to minimum. Because the maximum volume always occurs on the same side of the chamber and the minimum volume on the opposite side, it is necessary to provide porting also leading to significant thermodynamic advantages.

The schematics of FIGS. 7–10 also illustrate two chambers 20 and rotors 20 connected in tandem on the same crankshaft 40. The cranks of the crankshaft 40 are attached 180 degrees apart and the rotors are configured to be 90 degrees displaced. The chambers have ports 26 and 28 at the circumferential edge as shown to allow connection of the cold chamber at the left to the hot chamber at the right. The attachment also connects the heat exchangers 44 and 48 for the purpose of adding and rejecting heat. The heating heat exchanger 48 at the bottom adds heat and the cooling heat exchanger 44 at the top rejects heat.

Another way to describe the function is that in the first step of the cycle, heat is added at a constant volume. This is shown in FIG. 7 and the working fluid 60 contained to the right of the cold end rotor is transferred through the heat exchanger 48 to the expanding space to the left of the hot end as the engine rotates clockwise continuing to the position shown in FIG. 8. This results in the constant volume heat addition phase. Also during this time, the fluid to the right of the hot end will be transferred through the cooling heat exchanger 44 to the cold end achieving the process of constant volume heat rejection.

Figure 9:
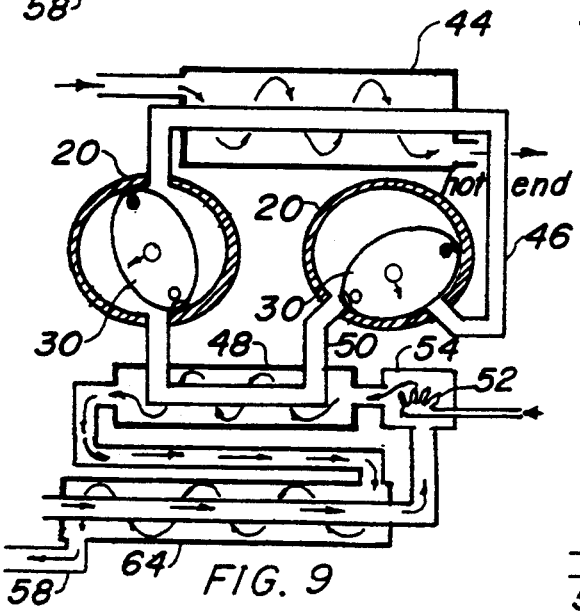
FIG. 9 is a diagram of the rotor position at the end of the heat expansion and cold contraction phase with porting about to occur.
Figure 10:
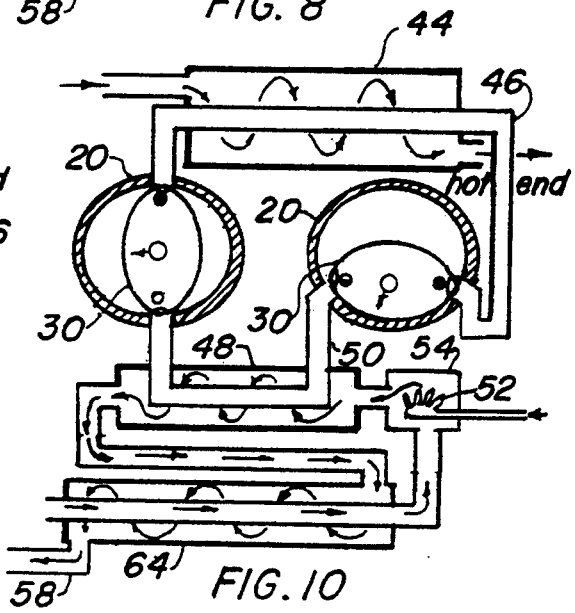
FIG. 10 is a diagram of the rotor position when porting is almost complete and constant volume heat transfer is about to begin on the opposite side of the rotors.

The second phase of the cycle is the power phase in which the heated working fluid 60 is allowed to expand and cool providing work against the left side of both rotors 30. The end of this phase is shown in FIG. 9. The hot side expanded while the cold side contracted such that the cooled gas is in the minimum volume space to the right of the cold rotor and the heated fluid is in the maximum volume above the hot rotor and to the left of the cold rotor. Assuming this process has been occurring repeatedly, the fluid at this point will be at its original temperature and pressure and the process is ready to occur again after the porting processing shown in FIG. 10. In summary, the invention provides constant volume heat addition and rejection during a half revolution of the crankshaft in which no work flows except for that necessary to overcome the forces of friction. During the second half revolution work is providing by the expansion and contraction of the working fluid.

As mentioned earlier, the portion process leads to some significant advantages. First, the working fluid flow is unidirectional except for a small amount of heated fluid going back to the cold end during the expansion phase. This is in contrast to the reciprocating type Stirling engine in which the fluid flows through both heat exchangers in series. Regenerators are required between the heat exchangers in the reciprocating system to maintain the fluid at nearly a constant temperature between the heat exchangers. This provides additional unwanted volume which reduces the pressure available to provide work output. Since the invention sweeps the fluid around the chamber it does not suffer appreciable heat loss because of the separation of mechanical parts that operate at widely different temperatures.

FIG. 11 illustrates the additional of optional heat exchangers to further improve the efficiency of the invention. A regenerative heat exchanger 62 is added between the cooling and heating heat exchanger 44 and 48 allowing residual heat transferred from the cold end of the system to pre-warm the working fluid 60 prior to entering the heating heat exchanger 48.

In either embodiment using combustion heat as the heat source, a pre-heat heat exchanger 64 may pre-heat the air entering the burner 52 utilizing all of the heat available furthering the energy utilization process. When solar heating is used, if the solar heat cannot be applied directly to the heater 48, then a remote solar collector 56 may be employed and the heat piped to heat exchanger 48 using a closed heat transfer system.

The invention is illustrated in FIG. 1 and in the schematics as having only a pair of chambers 20 and rotors 30 however, it should not be construed that only two must be used as two pair or even three pair may be employed with equal ease and to some advantage in many applications. It should be noted that if two pair are used, the angular displacement would be 180° and 120° for three pair.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

I claim:

1. A rotary Stirling cycle heat engine comprising:

a) at least a pair of hollow chambers oriented in parallel relationship, each having sidewalls and endwalls also a first port and a second port penetrating said sidewalls, b) an elliptical rotor disposed within each chamber in constant rotatable contact against the chambers having movable orientation means integral therewith, for coordination position of the rotor in the chamber, c) a crankshaft, connecting the rotors together in tandem at an opposed offset orientation, having stationary orientation means thereon interfacing with said movable orientation means for synchronizing the rotors in opposed concert, d) a cooling heat exchanger connected between the first ports of each chamber for heat extraction, e) a heating heat exchanger connected between the second ports of each chamber for adding heat to actuate the cycle, and f) working fluid sealably contained at a constant volume within said chambers and heat exchangers providing the operational potential to rotate each rotor when the volume of one chamber in communication with the first ports is at a maximum condition on one side and the volume of another chamber in communication with both second ports is minimum on an opposed side with heat from the heating heat exchanger expanding the fluid and the heat extracted from the cooling heat exchanger contracting the fluid creating a volumetric divergence hence a pressure differential applying pressure on one side of the rotor which applies force to an offset portion of the crankshaft causing torque on the crankshaft producing work while sweeping the fluid around the chambers through the ports.

2. The engine as recited in claim 1 wherein said hollow chambers are elliptical in shape described by rectangular coordinates in the equations:

$$x=t\ (Sin\ 2a+5\ Sin\ a)$$

$$and\ Y=t\ (Cos\ 2a+5\ Cos\ a)$$

where "t" is the crankshaft throw and "a" is one-half the crankshaft rotational angle in degrees (0° to 360° to completely describe the chamber sidewall).

3. The engine as recited in claim 1 wherein said rotor is shaped in the form of two intersecting arcs having a radius "r" whose centers are separated by the same distance "r". The distance "r" is defined by the equation:

$$r=L/Cos\ 30\ degrees$$

where L is equal to 5 times the crankshaft throw.

4. The engine as recited in claim 1 wherein said rotor further comprises a tip seal positioned and rotatable at the narrowest portion of the ellipse, sealing the rotor against the chamber sidewalls.

5. The engine as recited in claim 4 wherein said rotor further containing opposed curved grooves therein and a spring loaded curved side seal containably received within each groove contiguous with the tip seal, slideably sealing the rotor to the chamber endwalls.

6. The engine as recited in claim 1 wherein said movable orientation means comprises a centrally located internal toothed ring gear.

7. The engine as recited in claim 6 wherein said stationary orientation means comprises an external tooth pinion gear fixably attached to said chamber endwall meshing with the internal teeth of the ring gear such that rotation of the rotor within the chamber maintains continuity with the chamber sidewalls and the rotors synchronized in their relative position.

8. The engine as recited in claim 7 wherein the ring gear has twice the number of teeth as the pinion gear causing the rotor to rotate at one-half the rate of the crankshaft for system balance.

9. The engine as recited in claim 1 wherein said cooling heat exchanger further comprises a fluid to air device extracting heat from the working fluid and transferring it to ambient air using thermal counter flow combined with mass flow of each media.

10. The engine as recited in claim 1 wherein said heating heat exchanger further comprises a heat source and a conducting fluid with the heat source elevating the temperature of the conducting fluid and transferring heat to the working fluid through a mass flow of each media.

11. The engine as recited in claim 10 wherein the heat source further comprises a combustion burner using liquid fossil fuel.

12. The engine as recited in claim 10 wherein the heat source further comprises a combustion burner and gaseous fuel.

13. The engine as recited in claim 10 wherein the heat source further comprises a combustion burner and flammable gas as a fuel also a combustion air heat exchanger to pre-heat the air entering the burner.

14. The engine as recited in claim 10 wherein the conducting fluid is air.

15. The engine as recited in claim 10 wherein the conducting fluid is a liquid.

16. The engine as recited in claim 10 wherein the heat source further comprises a solar collector gathering solar energy.

17. The engine as recited in claim 10 further comprising a combustion process as the heat source having combustion air inlet means and exhaust outlet means also a combustion heat exchanger transferring residual heat from the exhaust outlet means to the air inlet means enabling the engine to utilize the maximum amount of heat from the combustion process.

18. The engine as recited in claim 1 wherein the working fluid further comprises air.

19. The engine as recited in claim 1 wherein said working fluid further comprises a gas.

20. The engine as recited in claim 1 further comprising a regenerative heat exchanger in communication with the cooling and heating heat exchanger transferring residual heat from the cooling heat exchanger prewarming the working fluid prior to entering the heating heat exchanger enabling the engine to utilize the maximum amount of heat available in the cycle.

21. The engine as recited in claim 1 further comprising two pair of chambers and rotors disposed at an angular displacement 180° apart.

22. The engine as recited in claim 1 further comprising three pair of chambers and rotors disposed at an angular displacement 120° apart.

* * * * *